US009813833B1

(12) United States Patent
Vesa

(10) Patent No.: US 9,813,833 B1
(45) Date of Patent: Nov. 7, 2017

(54) METHOD AND APPARATUS FOR OUTPUT SIGNAL EQUALIZATION BETWEEN MICROPHONES

(71) Applicant: Nokia Technologies Oy, Espoo (FI)

(72) Inventor: Sampo Vesa, Helsinki (FI)

(73) Assignee: Nokia Technologies Oy, Espoo (FI)

( * ) Notice: Subject to any disclaimer, the term of this patent is extended or adjusted under 35 U.S.C. 154(b) by 0 days.

(21) Appl. No.: 15/294,304

(22) Filed: Oct. 14, 2016

(51) Int. Cl.
*H04R 3/04* (2006.01)
*H04R 29/00* (2006.01)

(52) U.S. Cl.
CPC ..... *H04R 29/006* (2013.01); *H04R 3/04* (2013.01); *H04R 2430/03* (2013.01)

(58) Field of Classification Search
CPC ..... H04R 3/04; H04R 3/005; H04R 3/004; G10L 25/78; G10L 2021/02165
USPC ..... 381/58, 57, 18, 12, 61, 95, 103, 107
See application file for complete search history.

(56) References Cited

U.S. PATENT DOCUMENTS

| | | | | |
|---|---|---|---|---|
| 9,241,228 | B2 | 1/2016 | Ng et al. | |
| 9,363,598 | B1 | 6/2016 | Yang | |
| 2005/0276423 | A1* | 12/2005 | Aubauer | H04R 3/005 381/92 |
| 2007/0154037 | A1* | 7/2007 | Schwartz | H03G 3/32 381/118 |
| 2012/0162471 | A1 | 6/2012 | Sekiya et al. | |
| 2014/0341388 | A1 | 11/2014 | Goldstein et al. | |
| 2015/0325253 | A1 | 11/2015 | Matsuo | |

FOREIGN PATENT DOCUMENTS

| | | |
|---|---|---|
| EP | 2458586 | 5/2012 |
| WO | WO 2014/039028 | 3/2014 |

OTHER PUBLICATIONS

*Antares Vocal Processing > Products> Mic Mod EFX* [retrieved Nov. 10, 2016]. Retrieved from the Internet: <URL: http://www.antarestech.com/products/detail.php?product=Mic_Mod_EFX_5#overview>. 2 pages.

*Audo mixing—Wikipedia* [retrieved Nov. 9, 2016]. Retrieved from the Internet: <URL: https://en.wikipedia.org/wiki/Audio_mixing>. (Aug. 10, 2016) 2 pages.

(Continued)

*Primary Examiner* — Melur Ramakrishnaiah
(74) *Attorney, Agent, or Firm* — Alston & Bird LLP

(57) ABSTRACT

A method, apparatus and computer program product provide an improved filter calibration procedure to reliably equalize the long term spectrum of the audio signals captured by first and second microphones that are at different locations relative to a sound source and/or are of different types. In the context of a method, the signals captured by the first and second microphones are analyzed. The method also determines one or more quality measures based on the analysis. In an instance in which one or more quality measure satisfy a predefined condition, the method determines a frequency response of the signals captured by the first and second microphones. The method also determines a difference between the frequency response of the signals captured by the first and second microphones and processes the signals captured by the first microphone for filtering relative to the signals captured by the second microphone based upon the difference.

20 Claims, 7 Drawing Sheets

(56) References Cited

OTHER PUBLICATIONS

*Dynamic Equalizers, Part Two: Spectrum Matching with MAutoDynamicEQ* [retrieved Nov. 10, 2016]. Retrieved from the Internet: <URL: http://soundbytesmag.net/meldaproductionmautodynamiceq/>. 12 pages.

*How to Match Audio from Different Sound Sources* [retrieved Nov. 10, 2016]. Retrieved from the Internet: <URL: https://www.izotope.com/en/community/blog/tips-tutorials/2015/02/how-to-match-audio-from-different-sound-sources/>. (Feb. 4, 2015) 2 pages.

*Live sound mixing—Wikipedia* [retrieved Nov. 9, 2016]. Retrieved from the Internet: <URL: https://en.wikipedia.org/wiki/Live_sound_mixing>. (Jul. 1, 2016) 4 pages.

*Logic Studio Effects: Match EQ* [retrieved Nov. 10, 2016]. Retrieved from the Internet: <URL: https://documentation.apple.com/en/logicstudio/effects/index.html#chapter=5%26section=5%26tasks=true>. 6 pages.

Matching EQ [retrieved Nov. 10, 2016]. Retrieved from the Internet: <URL: http://help.izotope.com/docs/ozone/pages/modules_matching_eq.htm>. 2 pages.

*Microphone—Wikipedia* [retrieved Nov. 9, 2016]. Retrieved from the Internet: <URL: https://en.wikipedia.org/wiki/Microphone#Microphone_polar_patterns>. (Nov. 4, 2016) 22 pages.

*Microphone EQ* [retrieved Nov. 10, 2016]. Retrieved from the Internet: <URL: http://mathaudio.com/microphone-eq.htm>. 5 pages.

*Microphone practice—Wikipedia* [retrieved Nov. 9, 2016]. Retrieved from the Internet: <URL: https://en.wikipedia.org/wiki/Microphone_practice>. (Nov. 7, 2016) 5 pages.

*Multitrack recording—Wikipedia* [retrieved Nov. 9, 2016]. Retrieved from the Internet: <URL: https://en.wikipedia.org/wiki/Multitrack_recording>. (Sep. 3, 2016) 7 pages.

Perez_Gonzalez, E. et al., *Automatic Equalization of Multi-channel Audio Using Cross-adaptive Methods*, Engineering Society 127th Convention Paper, Audio Oct. 9-12, 2009, 6 pages.

*Proximity effect (audio)—Wikipedia* [retrieved Nov. 9, 2016]. Retrieved from the Internet: <URL: https://en.wikipedia.org/wiki/Proximity_effect_%28audio%29>. (Aug. 17, 2016) 3 pages.

*RX 5 Audio Editor: Noise Reduction & Audio Repair Software* [retrieved Nov. 10, 2016]. Retrieved from the Internet: <URL: https://www.izotope.com/en/products/repair-and-edit/rx.html/whats-new.html>. 4 pages.

* cited by examiner

METHOD AND APPARATUS FOR OUTPUT SIGNAL EQUALIZATION BETWEEN MICROPHONES

TECHNICAL FIELD

An example embodiment of the present disclosure relates generally to filter design and, more particularly, to output signal equalization between different microphones, such as microphones at different locations relative to a sound source and/or microphones of different types.

BACKGROUND

During the recording of the audio signals emitted by one or more sound sources in a space, multiple microphones may be utilized to capture the audio signals. In this regard, a first microphone may be placed near a respective sound source and a second microphone may be located a greater distance from the sound source so as to capture the ambience of the space along with the audio signals emitted by the sound source(s). In an instance in which the sound source is a person who is speaking or singing, the first microphone may be a lavalier microphone placed on the sleeve or lapel of the person. Following capture of the audio signals by the first and second microphones, the output signals of the first and second microphones are mixed. In the mixing of the output signals of the first and second microphones, the output signals of the first and second microphones may be processed so as to more closely match the long term spectrum of the audio signals captured by the first microphone with the audio signals captured by the second microphone. This matching of the long term spectrum of the audio signals captured by the first and second microphones is separately performed for each sound source since there may be differences in the types of microphone and the placement of the microphones relative to the respective sound source.

In order to approximately counteract the bass boost caused by placing a microphone with a directive pickup pattern, such as a cardioid or figure eight pattern, close to the sound source in the near field, a bass cut filter may be utilized to approximately match the spectrum of the same sound source as captured by the second microphone. Sometimes, however, it may be desirable to match the spectrum more accurately than that accomplished with the use of a bass cut filter. Thus, manually triggered filter calibration procedures have been developed.

In these filter calibration procedures, an operator manually triggers a filter calibration procedure, typically in an instance in which only the sound source recorded by the first microphone that is to be calibrated is active. A calibration filter is then computed based upon the mean spectral difference over a calibration period between the first and second microphones. Not only does this filter calibration procedure require manual triggering by the operator, but the operator generally must direct each sound source, such as the person wearing the first microphone, to produce or emit audio signals during a different time period in which the filter calibration procedure is performed for the first microphone associated with the respective sound source.

Thus, these filter calibration procedures are generally suitable for a post-production setting and not for the design of filters for live sound. Moreover, these filter calibration procedures may be adversely impacted in instances in which there is significant background noise such that the audio signals captured by the first and second microphones that are utilized for the calibration have a relatively low signal-to-noise ratio. Further, these filter calibration procedures may not be optimized for spatial audio mixing in an instance in which the audio signals captured by the first microphones associated with several different sound sources are mixed together with a common second microphone, such as a common microphone array for capturing the ambience, since the contribution of the audio signals captured by each of the first microphones cannot be readily separated for purposes of filter calibration.

BRIEF SUMMARY

A method, apparatus and computer program product are provided in accordance with an example embodiment in order to provide for an improved filter calibration procedure so as to reliably match or equalize a long term spectrum of the audio signals captured by first and second microphones that are at different locations relative to a sound source and/or are of different types. As a result of the enhanced equalization of the audio signals captured by the first and second microphones, the playback of the audio signals emitted by the sound source and captured by the first and second microphones may be improved so as to provide a more realistic listening experience. A method, apparatus and computer program product of an example embodiment provide for the automatic performance of a filter calibration procedure such that a resulting equalization of the long term spectrum of the audio signals captured by the first and second microphones is applicable not only to post production settings, but also for live sound. Further, the method, apparatus and computer program product of an example embodiment are configured to equalize the long term spectrum of the audio signals captured by the first and second microphones in conjunction with spatial audio mixing such that the playback of the audio signals that have been subjected to spatial audio mixing is further enhanced.

In accordance with an example embodiment, a method is provided that comprises analyzing one or more signals captured by each of the first and second microphones. In an example embodiment, the first microphone is closer to a sound source than the second microphone. The method also comprises determining one or more quality measures based on the analysis. In an instance in which one or more quality measure satisfy a predefined condition, the method determines a frequency response of the signals captured by the first and second microphones. The method also comprises determining a difference between the frequency response of the signals captured by the first and second microphones and processes the signals captured by the first microphone with a filter to correspondingly filter the signals captured by the first microphone relative to the signals captured by the second microphone based upon the difference.

The method of an example embodiment performs an analysis by determining a cross-correlation measure between the signals captured by the first and second microphones. In this example embodiment, the method determines a quality measure based upon a ratio of a maximum absolute value peak of the cross-correlation measure to a sum of absolute values of the cross-correlation measure. Additionally or alternatively, the method of this example embodiment determines a quality measure based upon a standard deviation of one or more prior locations of a maximum absolute value of the cross-correlation measure. Still further, the method of an example embodiment may determine a quality measure based upon a signal-to-noise ratio of the signals captured by the first microphone. The method of an example embodiment also comprises repeatedly performing the analysis and determining the frequency response in an instance in which one or more quality measures satisfy the predefined condition for the signals captured by the first and second microphones during each of the plurality of different time windows. In this example embodiment, the method also comprises estimating an average frequency response based on at least one of the signals captured by the first microphone and dependent on an estimated frequency response based on the at least one of the signals captured by the second microphone during each of the plurality of different time windows. The method of this example embodiment also comprises aggregating the different time windows for which the one or more quality measures satisfy a predefined condition. In this embodiment, the determination of the difference is dependent upon an aggregation of the time windows satisfying a predetermined condition.

In another example embodiment, an apparatus is provided that comprises at least one processor and at least one memory comprising computer program code with the at least one memory and computer program code configured to, with the at least one processor, cause the apparatus to analyze one or more signals captured by each of the first and second microphones. In an example embodiment, the first microphone is closer to a sound source than the second microphone. The at least one memory and the computer program code are also configured to, with the at least one processor, cause the apparatus to determine one or more quality measures based on the analysis and, in an instance in which the one or more quality measure satisfy a predefined condition, determine a frequency response of the signals captured by the first and second microphones. The at least one memory and the computer program code are further configured to, with the at least one processor, cause the apparatus to determine a difference between the frequency response of the signals captured by the first and second microphones and to process the signals captured by the first microphone with a filter to correspondingly filter the signals captured by the first microphone relative to the signals captured by the second microphone based upon the difference.

The at least one memory and the computer program code are further configured to, with the at least one processor, cause the apparatus of an example embodiment to perform the analysis by determining a cross-correlation measure between the signals captured by the first and second microphones. In this example embodiment, the at least one memory and the computer program code are configured to, with the at least one processor, cause the apparatus to determine a quality measure based upon a ratio of a maximum absolute value of the cross-correlation measure to a sum of absolute values of the cross-correlation measure. Additionally or alternatively, the at least one memory and the computer program code are configured to, with the at least one processor, cause the apparatus of this example embodiment to determine a quality measure based upon a standard deviation of one or more prior locations of a maximum absolute value of the cross-correlation measure.

The at least one memory and the computer program code are further configured to, with the at least one processor, cause the apparatus of an example embodiment to repeatedly perform the analysis and determine the frequency response in an instance in which the one or more quality measure satisfy the predefined condition for the signals captured by the first and second microphones during each of a plurality of different time windows. In this example embodiment, the at least one memory and the computer program code are further configured to, with the at least one processor, cause the apparatus to estimate an average frequency response based on at least one of the signals captured by the first microphone and dependent on an estimated frequency response based on the at least one of the signals captured by the second microphone during each of the plurality of different time windows. The at least one memory and computer program code are further configured to, with the at least one processor, cause the apparatus of this example embodiment to aggregate the different time windows for which the one or more quality measures satisfy the predefined condition. In this regard, the determination of the difference is dependent upon an aggregation of the time windows satisfying a predetermined condition.

In a further example embodiment, a computer program product is provided that comprises at least one non-transitory computer-readable storage medium having computer-executable program code portions stored therein with the computer-executable program code portions comprising program code instructions configured to analyze one or more signals captured by each of the first and second microphones. The computer-executable program code portions also comprise program code instructions configured to determine one or more quality measures based on the analysis and program code instructions configured to determine, in an instance in which the one or more quality measures satisfy a predefined condition, a frequency response of the signals captured by the first and second microphones. The computer-executable program code portions further comprise program code instructions configured to determine a difference between the frequency response of the signals captured by the first and second microphones and program code instructions configured to process the signals captured by the first microphone with a filter to correspondingly filter the signals captured by the first microphone relative to the signals captured by the second microphone based upon the difference.

The program code instructions configured to perform an analysis in accordance with an example embodiment comprise program code instructions configured to determine a cross-correlation measure between the signals captured by the first and second microphones. In this example embodiment, the program code instructions configured to determine one or more quality measures comprise program code instructions configured to determine the quality measure based upon a ratio of a maximum absolute value peak of the cross-correlation measure to a sum of absolute values of the cross-correlation measure. Additionally or alternatively, the program code instructions configured to determine one or more quality measures in accordance with this example embodiment comprise program code instructions configured to determine a quality measure based upon a standard deviation of one or more prior locations of a maximum absolute value of the cross-correlation measure. The computer-executable program code portions of an example embodiment also comprise program code instructions configured to repeatedly perform an analysis and determine the frequency response in an instance in which the one or more quality measure satisfy the predefined condition for the signals captured by the first and second microphones during each of a plurality of different time windows.

In yet another example embodiment, an apparatus is provided that comprises means for analyzing one or more signals captured by each of first and second microphones, such as means for determining a cross-correlation measure between signals captured by first and second microphones. The apparatus also comprises means for determining one or more quality measures based on the analysis. In an instance in which the one or more quality measures satisfy a predefined condition, the apparatus also comprises means for determining a frequency response of the signals captured by the first and second microphones. The apparatus of this example embodiment further comprises means for determining a difference between the frequency response of the signals captured by the first and second microphones and means for processing the signals captured by the first microphone with a filter to correspondingly filter the signals captured by the first microphone relative to the signals captured by the second microphone based upon the difference.

BRIEF DESCRIPTION OF THE DRAWINGS

Figure 1:
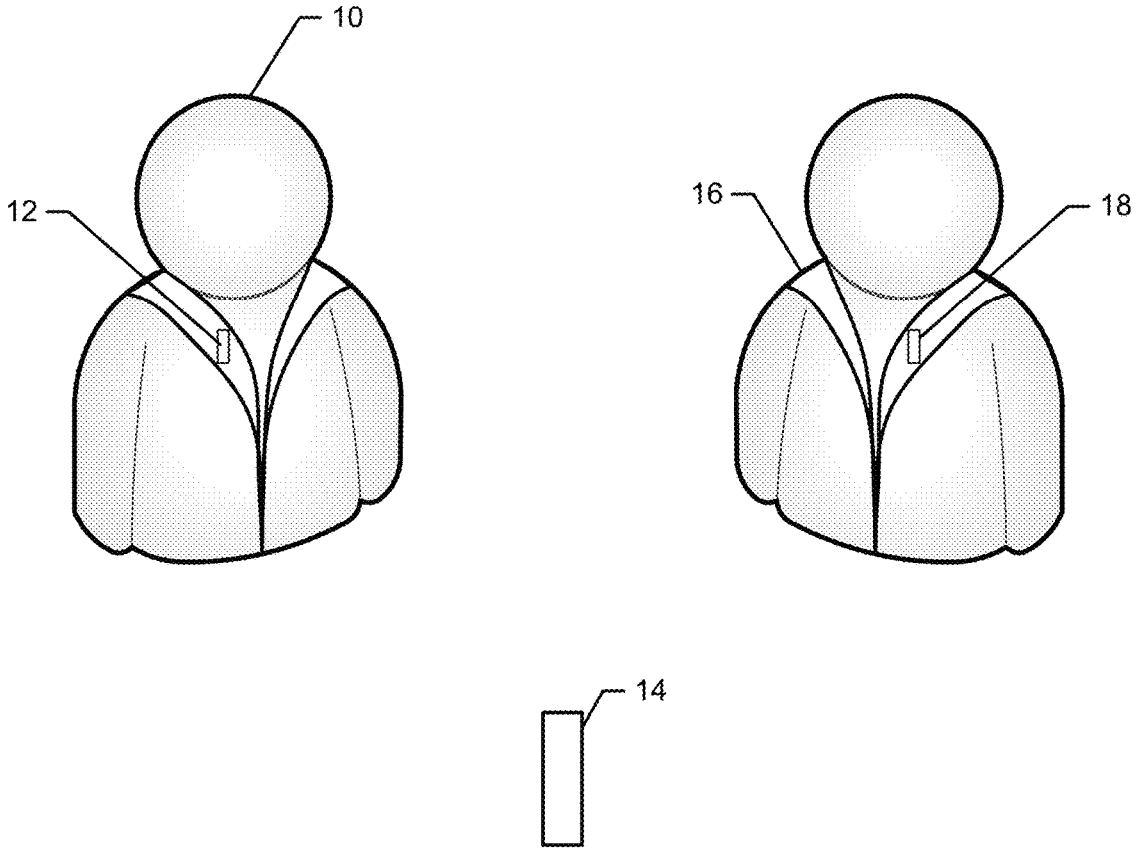
Figure 2:
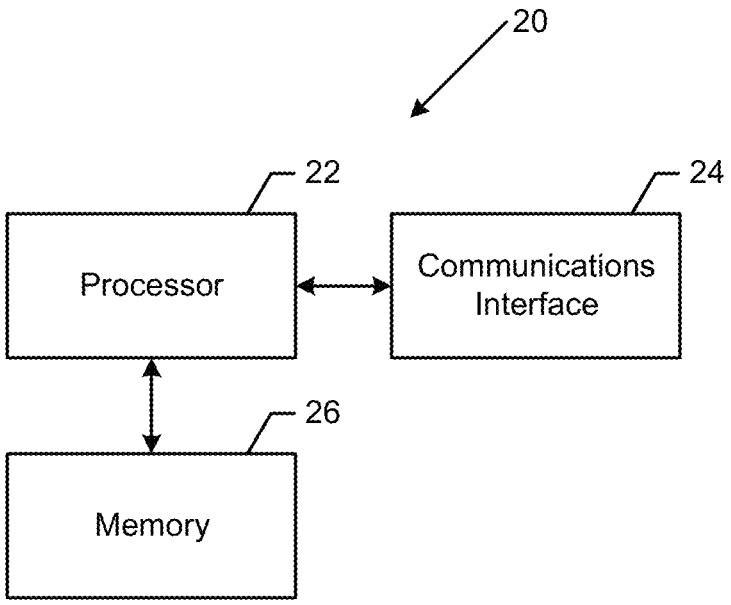
Figure 3A:
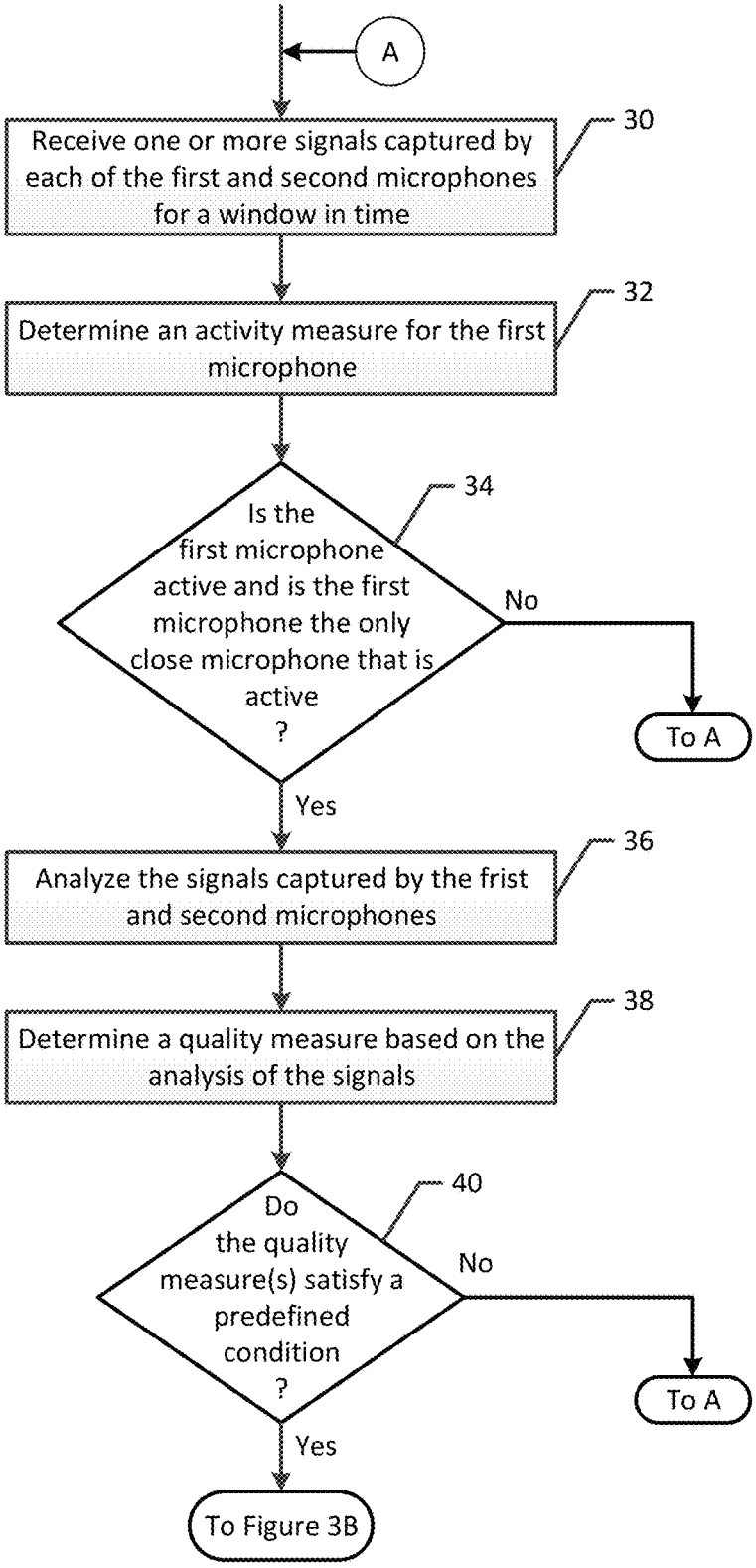
Figure 3B:
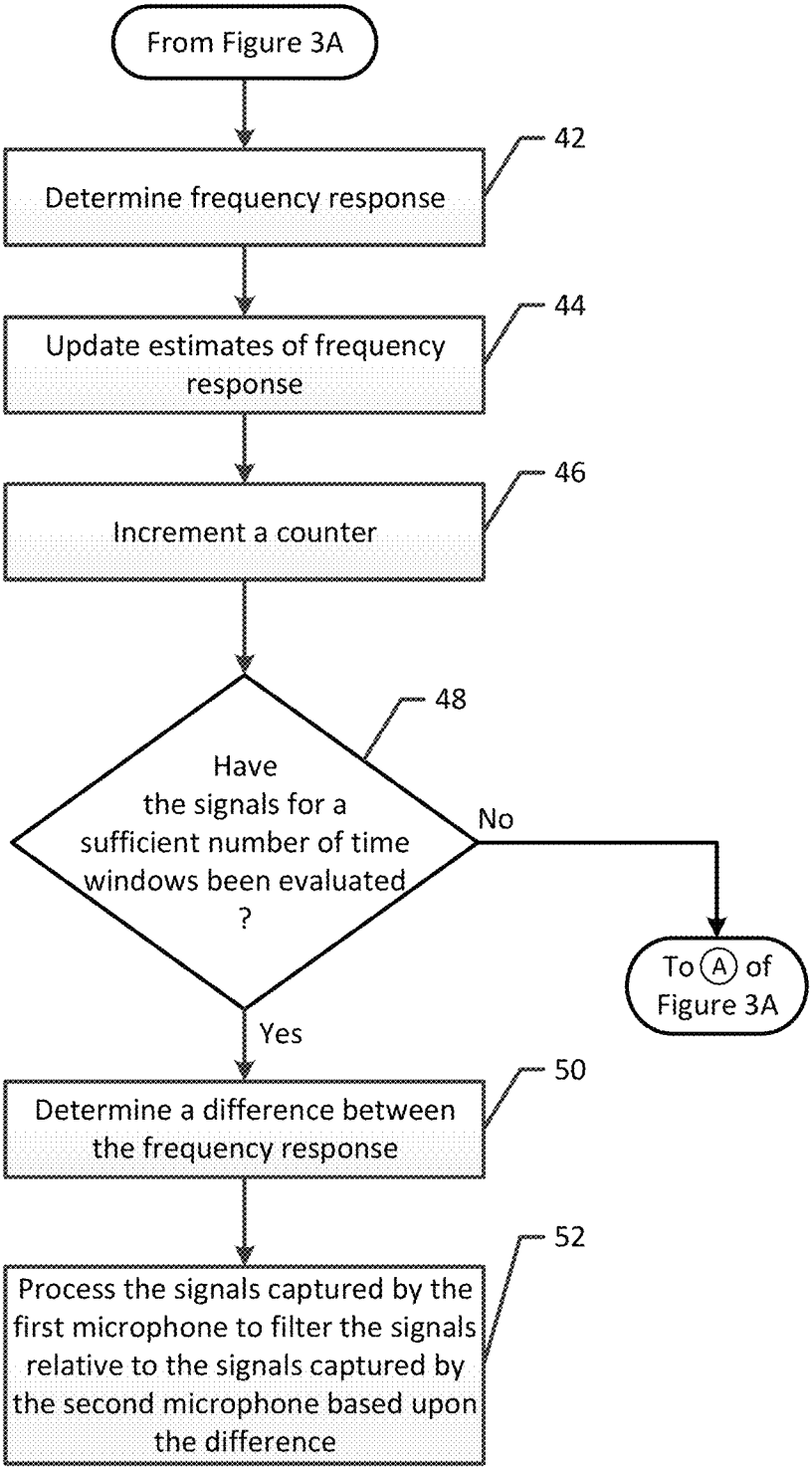
Figure 4A:
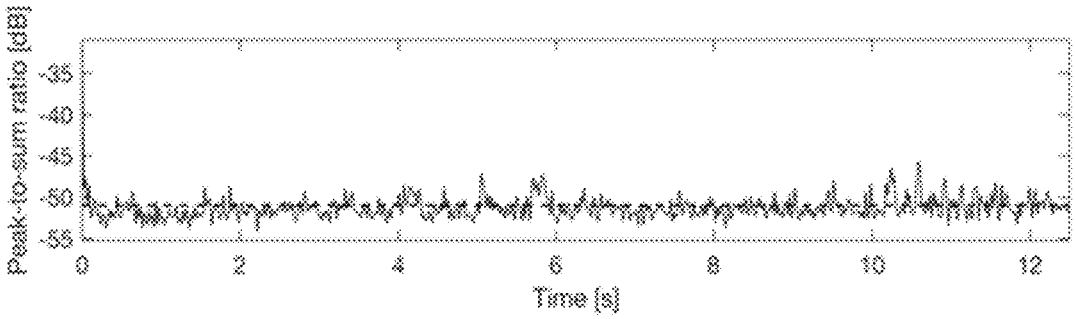
Figure 4B:
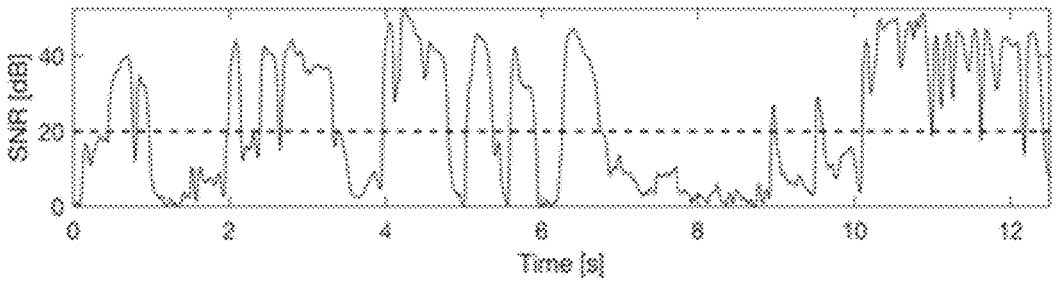
Figure 4C:
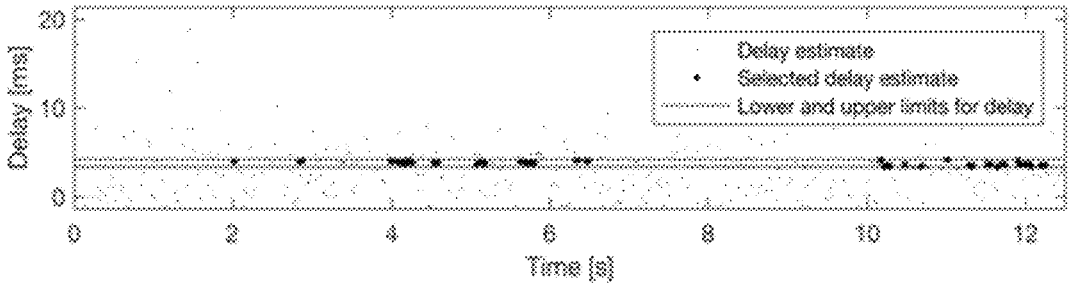
Figure 5:
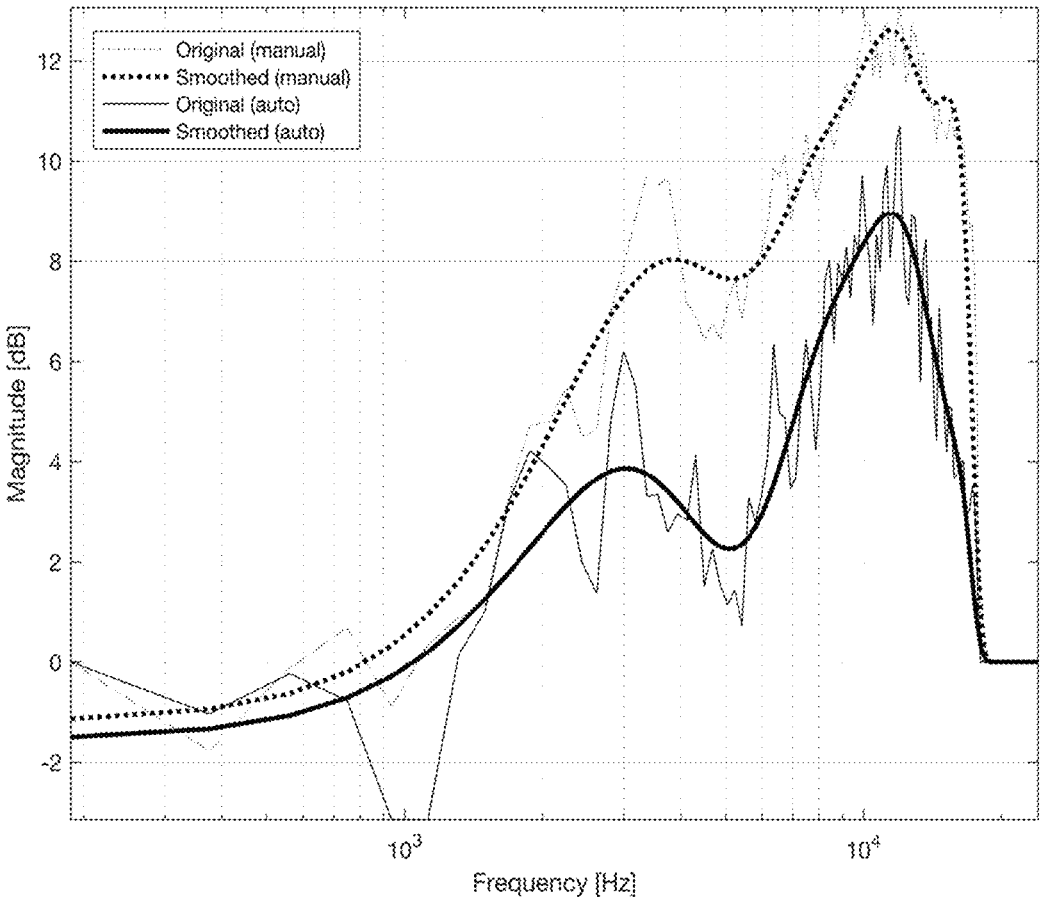
Figure 6:
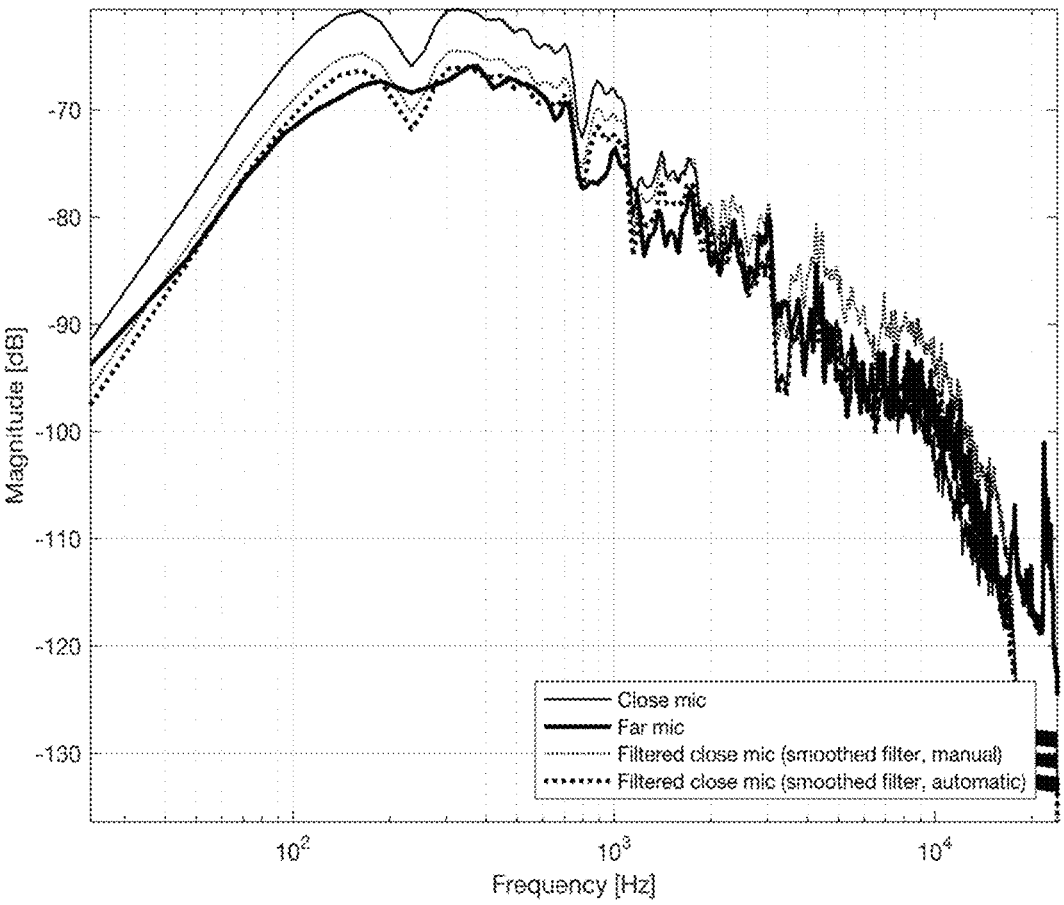

Having thus described certain example embodiments of the present disclosure in general terms, reference will hereinafter be made to the accompanying drawings, which are not necessarily drawn to scale, and wherein:

FIG. 1 is a schematic representation of two sound sources in the form of two different speakers, each having a first microphone attached to their lapel and being spaced some distance from a second microphone;

FIG. 2 is a block diagram of an apparatus that may be specifically configured in accordance with an example embodiment of the present disclosure;

FIGS. 3A and 3B are a flowchart illustrating operations performed, such as by the apparatus of FIG. 2, in accordance with an example embodiment of the present disclosure;

FIG. 4A is a graphical representation of a peak-to-sum ratio and a predefined threshold;

FIG. 4B is a graphical representation of a signal-to-noise ratio and a predefined threshold;

FIG. 4C is a graphical representation of delay estimates as well as selected delay estimates bounded by lower and upper limits for the delay;

FIG. 5 is a graphical representation of the magnitude response of a manually derived timbre-matching filter in comparison to the magnitude response of an automatically derived timbre-matching filter in accordance with an example embodiment of the present disclosure; and FIG. 6 is a graphical representation of the frequency response of the audio signals captured by first and second microphones as well as the filtering of the audio signals, both with a manually derived timbre-matching filter and with an automatically derived timbre-matching filter in accordance with an example embodiment of the present disclosure.

DETAILED DESCRIPTION

Some embodiments will now be described more fully hereinafter with reference to the accompanying drawings, in which some, but not all, embodiments are shown. Indeed, various embodiments may be embodied in many different forms and should not be construed as limited to the embodiments set forth herein; rather, these embodiments are provided so that this disclosure will satisfy applicable legal requirements. Like reference numerals refer to like elements throughout. As used herein, the terms "data," "content," "information," and similar terms may be used interchangeably to refer to data capable of being transmitted, received and/or stored in accordance with embodiments of the present disclosure. Thus, use of any such terms should not be taken to limit the spirit and scope of embodiments of the present disclosure.

Additionally, as used herein, the term 'circuitry' refers to (a) hardware-only circuit implementations (e.g., implementations in analog circuitry and/or digital circuitry); (b) combinations of circuits and computer program product(s) comprising software and/or firmware instructions stored on one or more computer readable memories that work together to cause an apparatus to perform one or more functions described herein; and (c) circuits, such as, for example, a microprocessor(s) or a portion of a microprocessor(s), that require software or firmware for operation even if the software or firmware is not physically present. This definition of 'circuitry' applies to all uses of this term herein, including in any claims. As a further example, as used herein, the term 'circuitry' also includes an implementation comprising one or more processors and/or portion(s) thereof and accompanying software and/or firmware. As another example, the term 'circuitry' as used herein also includes, for example, a baseband integrated circuit or applications processor integrated circuit for a mobile phone or a similar integrated circuit in a server, a cellular network device, other network device, and/or other computing device.

As defined herein, a "computer-readable storage medium," which refers to a non-transitory physical storage medium (e.g., volatile or non-volatile memory device), can be differentiated from a "computer-readable transmission medium," which refers to an electromagnetic signal.

A method, apparatus and computer program product are provided in order to equalize, typically in an automatic fashion without manual involvement or intervention, the long term average spectra of two different microphones that differ in location relative to a sound source and/or in type. By automatically equalizing the long term average spectra of different microphones that differ in location and/or type, the method, apparatus and computer program product of an example embodiment may be utilized either in a post-production setting or in conjunction with live sound in order to improve the audio output of the audio signals captured by the microphones.

FIG. 1 depicts an example scenario in which two different microphones in different locations and of different types capture the audio signals emitted by a sound source. In this regard, a first person 10 may serve as the sound source and may wear a first microphone 12, such as a lavalier microphone upon their lapel, their collar or the like. The first person may be a lecturer or other speaker, a singer or other type of performer to name just a few. As a result of the first microphone being carried by the first person, the first microphone may be referenced as a close-mike. As shown in FIG. 1, a second microphone 14 is also configured to capture the audio output by the sound source, such as the first person, as well as ambient noise. Thus, the second microphone is spaced further from the sound source than the first microphone. In some embodiments, the second microphone may also be of a different type than the first microphone. For example, the second microphone of one embodiment may be at least one of an array of microphones, such as one of the 8 microphones of the Nokia OZO™ system. Although the average spectra could be estimated over all microphones of an array, the microphone of any array that is closest to the sound source may serve as the second microphone in an example embodiment so as to maintain a line-of-sight relationship with the sound source and to avoid or limit shadowing. In an alternative embodiment in which the microphones are spherically arranged as in the Nokia OZO™ system, the average of two opposed microphones for which the normal to the line between the two opposed microphones points most closely to the sound source may serve as the second microphone. The second microphone may be referred to as the reference microphone.

In some scenarios, the second microphone 14 is located in a space that comprises multiple sound sources such that the second microphone captures the audio signals emitted not only by the first sound source, e.g., the first person 10, but also by a second and potentially more sound sources. In the illustrated example, a second person 16 serves as a second sound source and another first microphone 18 may be located near the second sound source, such as by being carried by the second person on their lapel, collar or the like. As such, the audio signals emitted by the second source are captured both by a first microphone, that is, the close-mike, carried by the second person and the second microphone.

In accordance with an example embodiment, an apparatus is provided that determines a suitable time period in which the long-term average spectrum of a sound source, such as the first person, that is present in the audio signals captured by first and second microphones can be equalized. Once a suitable time period has been identified, the long-term average spectra of the first and second microphones may be automatically equalized and a filter may be designed based thereupon in order to subsequently filter the audio signals captured by the first and second microphones. As a result, the audio output attributable to the audio signals emitted by the sound source and captured by the first and second microphones allows for a more enjoyable listening experience. Additionally, the automated filter design provided in accordance with an example embodiment may facilitate the mixing of the sound sources together since manual adjustment of the equalization is reduced or eliminated.

The apparatus may be embodied by a variety of computing devices, such as an audio/video player, an audio/video receiver, an audio/video recording device, an audio/video mixing device, a radio or the like. However, the apparatus may, instead, be embodied by or associated with any of a variety of other computing devices, including, for example, a mobile terminal, such as a portable digital assistant (PDA), mobile telephone, smartphone, pager, mobile television, gaming device, laptop computer, camera, tablet computer, touch surface, video recorder, radio, electronic book, positioning device (e.g., global positioning system (GPS) device), or any combination of the aforementioned, and other types of voice and text communications systems. Alternatively, the computing device may be a fixed computing device, such as a personal computer, a computer workstation, a server or the like. While the apparatus may be embodied by a single computing device, the apparatus of some example embodiments may be embodied in a distributed manner with some components of the apparatus embodied by a first computing device, such as an audio/video player, and other components of the apparatus embodied by a computing device that is separate from, but in communication with, the first computing device.

Regardless of the type of computing device that embodies the apparatus, the apparatus 20 of an example embodiment is depicted in FIG. 2 and is configured to comprise or otherwise be in communication with a processor 22, a memory device 24 and optionally a communication interface 26. In some embodiments, the processor (and/or co-processors or any other processing circuitry assisting or otherwise associated with the processor) may be in communication with the memory device via a bus for passing information among components of the apparatus. The memory device may be non-transitory and may include, for example, one or more volatile and/or non-volatile memories. In other words, for example, the memory device may be an electronic storage device (e.g., a computer readable storage medium) comprising gates configured to store data (e.g., bits) that may be retrievable by a machine (e.g., a computing device like the processor). The memory device may be configured to store information, data, content, applications, instructions, or the like for enabling the apparatus to carry out various functions in accordance with an example embodiment of the present invention. For example, the memory device could be configured to buffer input data for processing by the processor. Additionally or alternatively, the memory device could be configured to store instructions for execution by the processor.

As described above, the apparatus 20 may be embodied by a computing device. However, in some embodiments, the apparatus may be embodied as a chip or chip set. In other words, the apparatus may comprise one or more physical packages (e.g., chips) including materials, components and/or wires on a structural assembly (e.g., a baseboard). The structural assembly may provide physical strength, conservation of size, and/or limitation of electrical interaction for component circuitry included thereon. The apparatus may therefore, in some cases, be configured to implement an embodiment of the present invention on a single chip or as a single "system on a chip." As such, in some cases, a chip or chipset may constitute means for performing one or more operations for providing the functionalities described herein.

The processor 22 may be embodied in a number of different ways. For example, the processor may be embodied as one or more of various hardware processing means such as a coprocessor, a microprocessor, a controller, a digital signal processor (DSP), a processing element with or without an accompanying DSP, or various other processing circuitry including integrated circuits such as, for example, an ASIC (application specific integrated circuit), an FPGA (field programmable gate array), a microcontroller unit (MCU), a hardware accelerator, a special-purpose computer chip, or the like. As such, in some embodiments, the processor may include one or more processing cores configured to perform independently. A multi-core processor may enable multiprocessing within a single physical package. Additionally or alternatively, the processor may include one or more processors configured in tandem via the bus to enable independent execution of instructions, pipelining and/or multithreading.

In an example embodiment, the processor 22 may be configured to execute instructions stored in the memory device 24 or otherwise accessible to the processor. Alternatively or additionally, the processor may be configured to execute hard coded functionality. As such, whether configured by hardware or software methods, or by a combination thereof, the processor may represent an entity (e.g., physically embodied in circuitry) capable of performing operations according to an embodiment of the present invention while configured accordingly. Thus, for example, when the processor is embodied as an ASIC, FPGA or the like, the processor may be specifically configured hardware for conducting the operations described herein. Alternatively, as another example, when the processor is embodied as an executor of software instructions, the instructions may specifically configure the processor to perform the algorithms and/or operations described herein when the instructions are executed. However, in some cases, the processor may be a processor of a specific device (e.g., an audio/video player, an audio/video mixer, a radio or a mobile terminal) configured to employ an embodiment of the present invention by further configuration of the processor by instructions for performing the algorithms and/or operations described herein. The processor may include, among other things, a clock, an arithmetic logic unit (ALU) and logic gates configured to support operation of the processor.

The apparatus 20 may optionally also include the communication interface 26. The communication interface may be any means such as a device or circuitry embodied in either hardware or a combination of hardware and software that is configured to receive and/or transmit data from/to a network and/or any other device or module in communication with the apparatus. In this regard, the communication interface may include, for example, an antenna (or multiple antennas) and supporting hardware and/or software for enabling communications with a wireless communication network. Additionally or alternatively, the communication interface may include the circuitry for interacting with the antenna(s) to cause transmission of signals via the antenna(s) or to handle receipt of signals received via the antenna(s). In some environments, the communication interface may alternatively or also support wired communication. As such, for example, the communication interface may include a communication modem and/or other hardware/software for supporting communication via cable, digital subscriber line (DSL), universal serial bus (USB) or other mechanisms.

Referring now to FIGS. 3A and 3B, the operations conducted in accordance with an example embodiment, such as by the apparatus 20 of FIG. 2, are depicted. In this regard and as shown in block 30 of FIG. 3A, the apparatus of an example embodiment comprises means, such as the processor 22, the communication interface 26 or the like, for receiving one or more signals captured by each of the first and second microphones for a respective window in time. As described above and as shown in FIG. 1, the first and second microphones are different microphones that differ in location relative to a sound source and/or in type. The one or more signals that have been captured by each of the first and second microphones and that are received by the apparatus may be received in real time or may be received sometime following the capture of the audio signals by the first and second microphones, such as in an instance in which the apparatus is configured to process a previously captured recording in an offline or time-delayed manner.

Based upon the signals that are received, the apparatus 20 is configured to determine whether the sound source with which the first microphone is associated is active or is inactive. As shown in block 32 of FIG. 3A, the apparatus of an example embodiment comprises means, such as the processor 22 or the like, for determining an activity measure for the sound source with which the first microphone is associated. Although various activity measures may be determined, the apparatus, such as the processor, of an example embodiment is configured to determine the signal-to-noise ratio (SNR) for the signals that were captured by the first microphone during the respective window in time. The apparatus, such as the processor, is then configured to compare the activity measure, such as the SNR, of the signals captured by the first microphone during the respective window in time to a predefined threshold and to classify the sound source with which the first microphone is associated as active in an instance in which a quality measure satisfies the predetermined threshold. For example, in an instance in which the activity measure is the SNR of the signals captured by the first microphone within the respective window in time, the apparatus, such as the processor, of an example embodiment is configured to classify the sound source with which the first microphone is associated as being active in an instance in which the SNR equals or exceeds the predetermined threshold and to classify the sound source with which the first microphone is associated as inactive in an instance in which the SNR is less than the predetermined threshold.

In addition to determining whether the sound source with which the first microphone is associated is active or inactive, the apparatus 20 of an example embodiment is also configured to determine whether a sound source with which the first microphone is associated is the only close-mike that is active (at the time at which the audio signals are captured) in the space in which the second microphone also captures audio signals. In this regard, the apparatus includes means, such as the processor 22 or the like, of an example embodiment for determining an activity measure for every other sound source within the space based upon the audio signals captured by the close mikes associated with the other sound sources. See block 34 of FIG. 3A. In an instance in which either the sound source with which the first microphone is associated is inactive or in an instance in which another one of the sound sources in the space is active regardless of whether the sound source with which the first microphone is associated is active, the analysis of the audio signals captured during the respective window in time may be terminated and the process may, instead, continue with the analysis of signals captured by the first and second microphones during a different window in time, such as a subsequent window in time since the long-term average spectra is estimated for signals windows over a length of time, such as 1 to 2 seconds, greater than the length of the windows in time. However, in an instance in which the sound source with which the first microphone is associated is classified as active and, all other sound sources within the space are determined to be inactive, the apparatus, such as the processor, proceeds to further analyze the audio signals captured by the first and second microphones in order to equalize their long-term average spectra. The windows of time do not necessarily have to be consecutive as there may be invalid windows of time, e.g., windows of time in which the sound source is inactive or the correlation is too low, between the valid windows of time.

As shown in block 36 of FIG. 3A, the apparatus 20 of an example embodiment also comprises means, such as the processor 22 or the like, for analyzing signals captured by first and second microphones. Although various types of analyses may be performed, the apparatus, such as the processor, of an example embodiment compares the signals captured by the first and second microphones by performing a similarity analysis based upon a cross-correlation measure between signals captured by the first and second microphones. In this regard, the apparatus of an example embodiment includes means, such as the processor or the like, for determining a cross-correlation measure between signals captured by the first and second microphones. Various cross-correlation measures may be employed. In one embodiment, however, the apparatus, such as the processor, is configured to determine a cross-correlation measure utilizing a generalized cross-correlation with phase transform weighting (GCC-PHAT), which is relatively robust to room reverberation. Regardless of the type of cross-correlation measure, the cross-correlation measure is determined over a realistic set of lags between the first microphone associated with the sound source and the second microphone to which the first microphone is being matched. In this regard, the cross-correlation measure is determined across a range of delays that correspond to the time required for the audio signals produced by the sound source to travel from the first microphone associated with the sound source to the second microphone. For example, a range of lags over which the cross correlation measure is determined may be identified about a time value defined by the distance between the first and second microphones divided by the speed of sound, such as 344 meters per second. As described below, the equalization filter is estimated only for a certain distance range or different equalization filters may be estimated for different distance ranges. In this regard, distance is estimated based on the location of the cross-correlation peak estimated based on windows of time of the first and second microphones.

If the microphone signals are not captured by the same device, such as the same sound card, the delay between the microphone signals also includes the delay caused by the processing circuitry, e.g., a network delay if network-based audio is used. If the delay caused by the processing circuitry is known, the delay caused by the processing circuitry may be taken into account during the cross-correlation analysis by, for example, delaying the signal that is leading with respect to the other signal using, for example, a ring buffer in order to compensate for the processing delay. Alternatively, the processing delay can be estimated together with the sound travel delay.

Prior to utilizing the signals captured by the first and second microphones for the respective window in time for purposes of equalizing the long-term average spectra of the first and second microphones, the quality of the audio signals that were captured is determined such that only those audio signals that are of sufficient quality are thereafter utilized for purposes of equalizing long term average spectra of the first and second microphones. By excluding, for example, signals having significant background noise, the resulting filter designed in accordance with an example embodiment may provide for more accurate matching of the signals captured by the first and second microphones in comparison to manual techniques that utilize the entire range of signals, including those with significant background noise, for matching purposes.

As such, the apparatus 20 of the example embodiment comprises means, such as the processor 22 or the like, for determining one or more quality measures based on the analysis, such as the cross-correlation measure. See block 38 of FIG. 3A. Although various quality measures may be defined, the apparatus, such as the processor, of an example embodiment determines a quality measure based upon a ratio of an absolute value peak of the cross-correlation measure to a sum of absolute values of the cross-correlation measure. In this regard, the absolute value of each sample in the cross-correlation vector at each time step may be summed and may also be processed to determine the peak or maximum absolute value. The ratio of the peak to the sum may then be determined. For example, a ratio of the cross-correlation absolute value peak to the sum of the absolute values of the cross-correlation measure is shown in FIG. 4A over time along with a threshold as represented by a dashed line. Ratios exceeding the dashed line indicate confidence in the peak corresponding to a respective sound source.

Additionally or alternatively, the apparatus 20, such as the processor 22, of an example embodiment is configured to determine a quality measure based upon a standard deviation of one or more prior locations, that is, lags, of the maximum of the absolute value of the cross-correlation measure. In this regard, the absolute value of each sample in the cross-correlation vector at each time step may be determined and the location of the maximum absolute value may be identified. Ideally, this location corresponds to the delay, that is, the lag, between the signals captured by the first and second microphones. The location may be expressed in terms of samples or seconds/milliseconds (such as by dividing the estimated number of samples by the sampling rate in Hertz). The sign of the location indicates the signal which is ahead and the signal which is behind. In accordance with the determination of the standard deviation in an example embodiment, the locations of the latest delay estimates may be stored, such as in a ring buffer, and their standard deviation may be determined to measure the stability of the peak. The standard deviation is related in an inverse manner to the confidence that the distance between the first and second microphones has remained the same or very similar to the current spacing between the first and second microphones such that the current signals may be utilized for matching the spectra between the first and second microphones. Thus, a smaller standard deviation represents a greater confidence. The standard deviation also provides an indication as to whether the signals that were captured by the first and second microphones are useful and do not contain an undesirable amount of background noise as background noise would cause spurious delay estimates and increase the standard deviation. For example, FIG. 4B depicts the SNR of the audio signals captured by a first microphone over time with the dashed line representing the threshold above which the SNR indicates the sound source to be active.

Still further, the apparatus 20, such as the processor 22, of an example embodiment may additionally or alternatively determine the range at which the cross-correlation measure is at which corresponds to the distance range between the first and second microphones. Although the distance between the first and second microphones may be defined by radio-based positioning or ranging or other positioning methods, the distance between the first and second microphones is determined in an example embodiment based on delay estimates derived from the cross-correlations by converting the delay estimate to distance in meters by $d=c*\Delta t$ wherein c is the speed of sound, e.g., 344 meters/second, and $\Delta t$ is the delay estimate between the signals captured by the first and second microphones in seconds. By deriving the distance between the first and second microphones for a plurality of signals, a range of distances may be determined. By way of example, FIG. 4C graphically represents delay estimates over time for delays between 0 and 21.3 milliseconds, that is, the maximum delay that may be estimated with a fast Fourier transform of size 2048 at a sampling rate of 48 kilohertz. The range of delays between 0 and 21.3 milliseconds is divided into bins having a width of 0.84 milliseconds in this example embodiment which correspond to bins having a width of 29 centimeters (assuming a speed of sound of 344 meters per second). In an instance in which the first and second microphones are separated by a distance within the distance range of 1.15 meter to 1.44 meters, the delays within the bin having lower and upper delay limits of 3.35 milliseconds and 4.19 milliseconds, respectively, as identified by the horizontal dotted lines are selected since the lower and upper delay limits of 3.35 milliseconds and 4.19 milliseconds, respectively, of the bin correspond to a difference range of 1.15 meters to 1.44 meters between the first and second microphone, again assuming a speed of sound of 344 meters per second. The apparatus, such as the processor, may determine and analyze any one or any combination of the foregoing examples of quality measures and/or may determine other quality measures.

Regardless of the particular quality measures that are determined, the apparatus 20 includes means, such as the processor 22 or the like, for determining whether each quality measure that has been determined satisfies a respective predefined condition. See block 40 of FIG. 3A. While individual quality measures are discussed below, two or more quality measures may evaluated in some embodiments. With respect to a quality measure in the form of a ratio of an absolute value peak of the cross-correlation measure to a sum of absolute values of the cross-correlation measure, the ratio may be compared to a predefined condition in the form of a predefined threshold and the quality measure may be found to satisfy the predefined threshold in an instance in which the ratio is greater than the predefined threshold so as to indicate confidence in the peak of the cross-correlation measure corresponding to a sound source. In an embodiment in which the quality measure is in the form of the standard deviation of one or more prior locations of a maximum absolute value of the cross-correlation measure, the standard deviation may be compared to a predefined condition in the form of a predefined threshold and the respective quality measure may be found to satisfy the predefined threshold in an instance in which the standard deviation is less than the predefined threshold so as to indicate that the peak of the cross-correlation measure is sufficiently stable. In the embodiment in which the quality measure is in the form of the range of the cross-correlation measure, the range of the cross-correlation measure may be compared to a predefined condition in the form of a desired distance range between the first and second microphones and the respective quality measure may be found to be satisfied in an instance in which the range of the cross-correlation measure corresponds to, such as by equaling or lying within a predefined offset from, the distance range between the first and second microphones. As indicated by the foregoing examples, the predefined condition may take various forms depending upon the quality measure being considered.

In an instance in which one or more of the quality measures are not satisfied, the analysis of the audio signals captured during the respective window in time may be terminated and the process may, instead, continue with analysis of the signals captured by the first and second microphones during a different window in time, such as a subsequent window in time as described above. However, in an instance in which the one or more quality measures are determined to satisfy the respective predefined threshold, the apparatus 20 comprises means, such as the processor 22 or the like, for determining a frequency response, such as a magnitude spectra, of the signals captured by the first and second microphones. See block 42 of FIG. 3B. In other words, the magnitude spectrum of the signals captured by the first microphone is determined and the magnitude spectrum of the signals captured by the second microphone is determined. The frequency response, such as the magnitude spectrum, may be determined in various manners. However, the apparatus, such as the processor, of an example embodiment determines the magnitude spectrum based on fast Fourier transforms of the signals captured by the first and second microphones. Alternatively, the magnitude spectrum may be determined based on individual single frequency test signals that are generated one after another with the magnitude level of the captured test signals being utilized to form the magnitude spectrum. As another example, the signals could be divided into subbands with a filter bank with the magnitude of the subband signals then being determined in order to form the magnitude spectrum. Thus, the frequency response need not be determined based on multi-frequency signals captured at one time by the first and second microphones.

In an example embodiment, the apparatus 20 also comprises means, such as the processor 22 or the like, for estimating an average frequency response based on at least one of the signals captured by the first microphone and dependent on an estimated frequency response based on the at least one of the signals captured by the second microphone during each of the plurality of different time windows. See block 44 of FIG. 3B. In this regard, the apparatus, such as the processor, may be configured to determine the average spectra, such as by accumulating a sum of the short-term spectra, for the first microphone and for the second microphone during each of the plurality of different time windows. In an example embodiment, the apparatus, such as the processor, estimates the average spectra by updating estimates of the average spectra since a running estimate is maintained from one time window to the next. By way of example, the apparatus, such as the processor, of an example embodiment is configured to estimate the average spectra by accumulating, that is, summing, the absolute values of individual frequency bins into the estimated average spectra so as to compute a running mean, albeit without normalization. In this regard, the estimated average spectra for two matched signals i=1, 2 received by the first and second microphones may be initially set to $S_i(k, 0)=0$ in with the second argument in parentheses being the time-domain signal window index n with all frequency bins k=1, . . . , N/2+1, thereby extending from DC to the Nyquist frequency with N being the length of the fast Fourier transform. In this example, as the short-time Fourier transforms (STFTs) of the valid frames of the two signals are captured, the average spectra is estimated as $S_i(k, n)=S_i(k, n-1)+|X_i(k,n)|$ wherein $X_i(k,n)$ is the STFT of the input signal at frequency bin k and time-domain signal window index n.

As shown in block 46, the apparatus 20 of an example embodiment also comprises means, such as the processor 22, the memory device 24 or the like, for maintaining a counter and for incrementing the counter for each window in time during which signals captured by the first and second microphones are received and analyzed for which the sound source associated with the first microphone is determined to be the only active sound source in the space and the quality measure(s) associated with signals captured by the first and second microphones satisfy the respective predefined conditions.

The apparatus 20 of an example embodiment also comprises means, such as the processor 22 or the like, for determining whether the signals for a sufficient number of time windows have been evaluated, as shown in block 48 of FIG. 3B. In this regard, the apparatus of an example embodiment comprises means, such as the processor or the like, for aggregating the different time windows for which the one or more quality measures satisfy a predefined condition and then determining if a sufficient number of time windows have been evaluated. Various predetermined conditions may be defined for identifying whether a sufficient number of time windows have been evaluated. For example, the predetermined condition may be a predefined count that a counter of time windows that have been evaluated must reach in order to conclude that a sufficient number of time windows have been evaluated. For example, the predefined count may be set to a value that equates to a predefined length of time, such as one second, such that in an instance in which the count of the number of windows that have been evaluated equals the predefined count, the aggregate time covered by the windows of time is at least the predefined length of time. By way of example, FIG. 4C depicts a situation in which a sufficient number time windows of the signals having a selected delay between 3.35 ms and 4.19 ms (corresponding to microphones separated by a distance within a range of 1.15 meters and 1.44 meters) have been evaluated since the time windows of the signals having the selected delay sum to 1.1 seconds, thereby exceeding the threshold of 1 second. In an instance in which an insufficient number of windows of time have been evaluated the process may be repeated with the apparatus, such as the processor, being configured to repeatedly perform the analysis and determine the frequency response for signals captured by the first and second microphones for different time windows until a sufficient number of time windows have been evaluated.

Once a sufficient number of time windows have been aggregated, however, the apparatus 20, such as the processor 22, is configured to further process the signals captured by the first and second microphones by determining a difference, such as a spectrum difference, in a manner that is dependent upon the aggregation of the time windows satisfying a predetermined condition. In this regard, the apparatus of an example embodiment comprises means, such as a processor or the like, for determining, once a sufficient number of time windows have been evaluated, a difference between the frequency response of the signals captured by the first and second microphones. See block 50 of FIG. 3B. Prior to determining the difference, the apparatus, such as the processor, of an example embodiment is configured to normalize the total energy of the signals captured by the first and second microphones and to then determine the difference between the frequency response, as normalized, of the signals captured by the first and second microphones. While the total energy of the signals captured by the first and second microphones may be normalized in various manners, the signals of an example embodiment may be normalized based on, for example, a linear gain ratio determined from the time-domain signals prior to determining the difference, such as in decibels or in a linear ratio. Although the gain normalization may be computed in either the time or frequency domain, the gain normalization factor in the frequency domain between the signals designated 1 and 2 captured by the first and second microphones, respectively, may be defined as $$g = \sum_{k=1}^{N/2+1} S_2(k) \Big/ \sum_{k=1}^{N/2+1} S_1(k)$$

and may be computed once a sufficient number of signals have been accumulated and the filter from matching the long-term average spectrum of the signals designated 1 and 2 captured by the first and second microphones, respectively, is then computed. In this example, the computation of the filter proceeds by first computing the ratio of the accumulated spectrum $R(k)=S_2(k)/(g*S_1(k))$ at each frequency bin k. The gain normalization factor g aligns the overall levels of the accumulated spectra before computing the ratio of the spectra. Subsequently, the same gain normalization factor can be applied to the time domain signals captured by the first microphone to match their levels with signals captured by the second microphone, if desired.

Based on the difference, the apparatus 20 also comprises means, such as the processor 22 or the like, for processing the signals captured by the first microphone with a filter to correspondingly filter the signals captured by the first microphone relative to the signals captured by the second microphone based upon the difference. See block 52 of FIG. 3B. For example, the apparatus, such as the processor, may be configured to process the signals captured by the first microphone by providing filter coefficients to permit the signals captured by the first microphone to be correspondingly filtered relative to the signals subsequently captured by the second microphone. In this regard, the filter coefficients may be designed to equalize the spectrum of the signals captured by the first microphone to the signals captured by the second microphone. The filter resulting from the filter coefficients may be implemented in either the frequency domain or in the time domain. In some embodiments, the apparatus, such as the processor, is also configured to smooth the filtering over frequency. Although the equalization may be performed across all frequencies, the apparatus, such as the processor, of an example embodiment is configured so as to restrict the equalization to a predefined frequency band, such as by rolling off the filter above a cutoff frequency over a transition band so as not to equalize higher frequencies.

The apparatus 20 of an example embodiment may provide the filter coefficients and to process the signals captured by the first microphone in either real time with live sound or in a post-production environment. In a real time setting with live sound, a mixing operator may, for example, request each sound source, such as each musician and each vocalist, to separately play or sing, without anyone else playing or singing. Once each sound source provides enough audio signals such that a sufficient number of time windows have been evaluated, an equalization filter may be determined in accordance with an example embodiment for the first microphone, that is, the close-mike, associated with each of the instruments and vocalists. In a post-production environment, a similar sound check recording may be utilized to determine the equalization filter for the signals generated by each different sound source.

In order to illustrate an advantages provided by an embodiment of the present disclosure and with reference to FIG. 5, the magnitude response of a manually derived equalization filter is illustrated by the curve formed by small dots and a cepstrally smoothed representation of the manually derived equalization filter is represented by the curve formed by larger dots. In comparison, the equalization filter automatically derived in accordance with an example embodiment of the present disclosure is shown by the thinner solid line with the cepstrally smoothed representation of the magnitude response of the automatically derived equalization filter depicted with a thicker solid line. As will be noted, there is a clear difference between the filters at least at frequencies above 1 kilohertz, as the manually derived filter has approximately 4 decibels more gain above 1 kilohertz.

By way of another example, FIG. 6 depicts the frequency response of the audio signals captured over a range of frequencies by the first microphone, that is, the close-mike, and the second microphone, that is the far-mike. The results of filtering the signals received by the first microphone with an equalization filter derived manually and also derived automatically in accordance with an example embodiment of the present disclosure are also shown with the automatically derived equalization filter being more greatly influenced by the audio signals captured by the second microphone. Thus, the signals filtered in accordance with the automatically derived equalization filter of an example embodiment more closely represent the signals captured by the first microphone for most frequency ranges.

Although described above in conjunction with the design of a filter to equalize the long term average spectra of the signals captured by a first microphone and a second microphone, the method, apparatus 20 and computer program product of an example embodiment may also be employed to separately design for one or more other first microphones, that is, other close-mics, associated with other sound sources in the same space. Thus, the playback of the audio signals captured by the various microphones within the space is improved and the listening experience is correspondingly enhanced. Additionally, the automated filter design provided in accordance with an example embodiment may facilitate the mixing of the sound sources by reducing or elimination manual adjustment of the equalization.

As described above, FIGS. 3A and 3B illustrate flowcharts of an apparatus 20, method, and computer program product according to example embodiments of the invention. It will be understood that each block of the flowcharts, and combinations of blocks in the flowcharts, may be implemented by various means, such as hardware, firmware, processor, circuitry, and/or other devices associated with execution of software including one or more computer program instructions. For example, one or more of the procedures described above may be embodied by computer program instructions. In this regard, the computer program instructions which embody the procedures described above may be stored by the memory device 24 of an apparatus employing an embodiment of the present invention and executed by the processor 22 of the apparatus. As will be appreciated, any such computer program instructions may be loaded onto a computer or other programmable apparatus (e.g., hardware) to produce a machine, such that the resulting computer or other programmable apparatus implements the functions specified in the flowchart blocks. These computer program instructions may also be stored in a computer-readable memory that may direct a computer or other programmable apparatus to function in a particular manner, such that the instructions stored in the computer-readable memory produce an article of manufacture the execution of which implements the function specified in the flowchart blocks. The computer program instructions may also be loaded onto a computer or other programmable apparatus to cause a series of operations to be performed on the computer or other programmable apparatus to produce a computer-implemented process such that the instructions which execute on the computer or other programmable apparatus provide operations for implementing the functions specified in the flowchart blocks.

Accordingly, blocks of the flowcharts support combinations of means for performing the specified functions and combinations of operations for performing the specified functions for performing the specified functions. It will also be understood that one or more blocks of the flowcharts, and combinations of blocks in the flowcharts, can be implemented by special purpose hardware-based computer systems which perform the specified functions, or combinations of special purpose hardware and computer instructions.

In some embodiments, certain ones of the operations above may be modified or further amplified. Furthermore, in some embodiments, additional optional operations may be included. Modifications, additions, or amplifications to the operations above may be performed in any order and in any combination.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. Although specific terms are employed herein, they are used in a generic and descriptive sense only and not for purposes of limitation.

That which is claimed is:

1. A method comprising:

analyzing respective signals captured by each of the first and second microphones;

determining one or more quality measures based on the analysis;

in an instance in which the one or more quality measures satisfy a predefined condition, determining frequency responses of the signals captured by the first and second microphones;

determining a difference between the frequency response of the signals captured by the first and second microphones; and processing the signal captured by the first microphone with a filter to correspondingly filter the signal captured by the first microphone relative to the signal captured by the second microphone based upon the difference.

2. A method according to claim 1 wherein analyzing the signals comprises determining a cross-correlation measure between the signals captured by the first and second microphones.

3. A method according to claim 2 wherein determining one or more quality measures comprises determining a quality measure based upon a ratio of a maximum absolute value of the cross-correlation measure to a sum of absolute values of the cross-correlation measure.

4. A method according to claim 2 wherein determining one or more quality measures comprises determining a quality measure based upon a standard deviation of one or more prior locations of a maximum absolute value of the cross-correlation measure.

5. A method according to claim 1 further comprising repeatedly analyzing the signals and determining the frequency responses in an instance in which the one or more quality measures satisfy the predefined condition for the signals captured by the first and second microphones during each of a plurality of different time windows.

6. A method according to claim 5 further comprising estimating an average frequency response based on the signal captured by the first microphone and dependent on an estimated frequency response based on the signal captured by the second microphone during each of the plurality of different time windows.

7. A method according to claim 5 further comprising aggregating the different time windows for which the one or more quality measures satisfy a predefined condition, and wherein determining the difference is dependent upon an aggregation of the time windows satisfying a predetermined condition.

8. A method according to claim 1 wherein the first microphone is closer to a sound source than the second microphone.

9. An apparatus comprising at least one processor and at least one memory comprising computer program code, the at least one memory and the computer program code configured to, with the at least one processor, cause the apparatus to:

analyze respective signals captured by each of the first and second microphones;

determine one or more quality measures based on the analysis;

in an instance in which the one or more quality measures satisfy a predefined condition, determine frequency responses of the signals captured by the first and second microphones;

determine a difference between the frequency responses of the signals captured by the first and second microphones; and process the signal captured by the first microphone with a filter to correspondingly filter the signal captured by the first microphone relative to the signal captured by the second microphone based upon the difference.

10. An apparatus according to claim 9 wherein the at least one memory and the computer program code are configured to, with the at least one processor, cause the apparatus to analyze the signals by determining a cross-correlation measure between the signals captured by the first and second microphones.

11. An apparatus according to claim 10 wherein the at least one memory and the computer program code are configured to, with the at least one processor, cause the apparatus to determine one or more quality measures by determining a quality measure based upon a ratio of a maximum absolute value of the cross-correlation measure to a sum of absolute values of the cross-correlation measure.

12. An apparatus according to claim 10 wherein the at least one memory and the computer program code are configured to, with the at least one processor, cause the apparatus to determine one or more quality measures by determining a quality measure based upon a standard deviation of one or more prior locations of a maximum absolute value of the cross-correlation measure.

13. An apparatus according to claim 9 wherein the at least one memory and the computer program code are further configured to, with the at least one processor, cause the apparatus to repeatedly analyze the signals and determine the frequency responses in an instance in which the one or more quality measures satisfy the predefined condition for the signals captured by the first and second microphones during each of a plurality of different time windows.

14. An apparatus according to claim 13 wherein the at least one memory and the computer program code are further configured to, with the at least one processor, cause the apparatus to estimate an average frequency response based on the signal captured by the first microphone and dependent on an estimated frequency response based on the signal captured by the second microphone during each of the plurality of different time windows.

15. An apparatus according to claim 13 wherein the at least one memory and the computer program code are further configured to, with the at least one processor, cause the apparatus to aggregate the different time windows for which the one or more quality measures based on the similarity analysis satisfy a predefined condition, and wherein determining the difference is dependent upon an aggregation of the time windows satisfying a predetermined condition.

16. An apparatus according to claim 9 wherein the first microphone is closer to a sound source than the second microphone.

17. A computer program product comprising at least one non-transitory computer-readable storage medium having computer-executable program code portions stored therein, the computer-executable program code portions comprising program code instructions configured to:

analyze respective signals captured by each of the first and second microphones;

determine one or more quality measures based on the analysis;

in an instance in which the one or more quality measures satisfy a predefined condition, determine frequency responses of the signals captured by the first and second microphones;

determine a difference between the frequency responses of the signals captured by the first and second microphones; and process the signal captured by the first microphone with a filter to correspondingly filter the signal captured by the first microphone relative to the signal captured by the second microphone based upon the difference.

18. A computer program product according to claim 17 wherein the program code instructions configured to analyze the signals comprise program code instructions configured to determine a cross-correlation measure between the signals captured by the first and second microphones.

19. A computer program product according to claim 18 wherein the program code instructions configured to determine one or more quality measures comprise program code instructions configured to determine at least one of a quality measure based upon a ratio of a maximum absolute value of the cross-correlation measure to a sum of absolute values of the cross-correlation measure or a standard deviation of one or more prior locations of the maximum absolute value of the cross-correlation measure.

20. A computer program product according to claim 17 wherein the computer-executable program code portions further comprise program code instructions configured to repeatedly analyze the signals and determine the frequency responses in an instance in which the one or more quality measures satisfy the predefined threshold for the signals captured by the first and second microphones during each of a plurality of different time windows.

* * * * *